United States Patent [19]

Hegele

[11] 4,210,273

[45] Jul. 1, 1980

[54] BOTTOM-UNLOADING BULK CONTAINER

[75] Inventor: Charles D. Hegele, Knoxville, Tenn.

[73] Assignee: Inland Container Corporation, Indianapolis, Ind.

[21] Appl. No.: 14,240

[22] Filed: Feb. 22, 1979

[51] Int. Cl.² ..... B65D 5/72; B65D 17/00

[52] U.S. Cl. ..... 229/17 B; 229/23 C; 108/55.1

[58] Field of Search ..... 229/17 B, 23 C, 23 B, 229/23 T; 222/574, 528; 206/386; 108/55.1

[56] References Cited

U.S. PATENT DOCUMENTS

| | | | |
|---|---|---|---|
| 2,445,038 | 7/1948 | Riemenschneider et al. | 108/55.1 X |
| 3,136,472 | 6/1964 | Waller et al. | 229/23 C |
| 3,207,412 | 9/1965 | Bronte et al. | 229/17 B |
| 3,318,473 | 5/1967 | Jones et al. | 108/55.1 X |
| 3,480,196 | 11/1969 | De Simas | 108/55.1 X |
| 3,486,612 | 12/1969 | Kivell | 229/23 BT X |
| 3,606,969 | 9/1971 | Voytko | 229/17 B X |
| 3,750,932 | 8/1973 | Ellison | 229/37 R |
| 3,921,892 | 11/1975 | Macie | 229/17 B |
| 4,043,502 | 8/1977 | Croley | 229/23 BT X |

*Primary Examiner*—Davis T. Moorhead
*Attorney, Agent, or Firm*—Fitch, Even & Tabin

[57] ABSTRACT

A bottom-unloading bulk container having a bottom closure and having a top closure that includes flaps hinged to the body walls. Openings in the side walls are proportioned to receive the tines of a forklift truck. These openings are located a predetermined distance below the top edge of the sidewalls, and longitudinal wooden slats are located just above these sidewall openings. Bands encircle the body and the top and bottom closures at locations just interior of the sidewall openings. The container can be filled through an inlet provided by partly unfolding the top flaps after banding. After reaching its destination, the filled container can be lifted and transported to an unloading location by a forklift truck whose tines extend through the sidewalls openings and its contents dumped through the bottom opening upon release of the encircling bands.

11 Claims, 13 Drawing Figures

BOTTOM-UNLOADING BULK CONTAINER

BACKGROUND OF THE INVENTION

The present invention relates generally to fiberboard containers formed from folded blanks which are adapted for the shipment of bulk, flowable materials.

Bulk flowable materials are frequently shipped in large corrugated fiberboard containers of a size such as to require mechanical handling and thus shipment and handling atop a pallet. Oftentimes it may be desirable to be able to quickly unload the contents of such a bulk container into a receptacle at the shipping destination, and there are advantages to being able to unload or dump the bulk container through its bottom. While various types of container designs have been proposed which incorporate such a bottom unloading feature, none have been totally satisfactory.

BRIEF SUMMARY OF THE INVENTION

The present invention provides a bulk container which will quickly and completely dump its entire contents through its bottom once located above the desired receptacle and released. The bulk container is designed to be moved into the unloading position via a mechanical fork lift truck, and once in position, dumping is quickly effected by severing a pair of encircling bands. A preferred feature of the invention is its ability to be filled with the flowable material through a recloseable inlet in its top closure after the encircling bands have been applied. Moreover, the incorporation in the container of a bellows-type bottom closure provides a flow-directing discharge spout which assures the material which was shipped is channeled into the receptacle.

DETAILED DESCRIPTION OF THE PREFERRED EMBODIMENT

Figure 1:
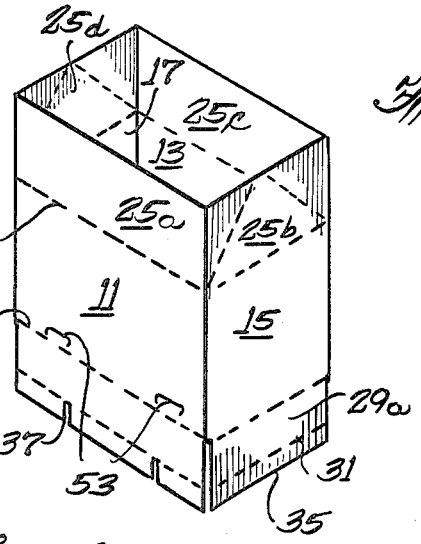
FIG. 1 is a perspective view of a tubular blank for forming a bulk container embodying various features of the invention shown in the inverted position.

A bulk container is formed from a large corrugated fiberboard blank which has been cut and scored to provide a body portion which comprises a pair of side walls 11 and 13 and a pair of end walls 15 and 17, that are defined by four, parallel, vertical score lines and that are hingedly interconnected to one another. The blank is formed into its illustrated tubular shape by means of a manufacturer's joint created by attachment of a short flap 19 hinged to the edge of the side panel 11 to the outer surface of the end panel 17 (see FIG. 3). The blank from which the container is formed is made from corrugated fiberboard of appropriate strength, and it may be single wall, double wall or even triple wall corrugated board, the flutes of which may be the same or different sizes and preferably run in the vertical direction.

The upper and lower boundaries of the body of the container are defined by score lines 21 and 23, respectively. A bottom closure is provided by four bottom flaps 25*a, b, c* and *d* which are each interconnected to one another at score lines so as to form an integral, short, tubular skirt or sleeve which is scored to provide a bellows-type closure. The preferred and illustrated closure is of the type shown in U.S. Pat. No. 3,750,932 which issued on Aug. 7, 1973. The minor bottom flaps 25*b* and 25*d* are provided with converging score lines which extend from the respective corners to termination points along the free edge which are spaced a short distance apart, as shown in FIG. 1.

Figure 2:
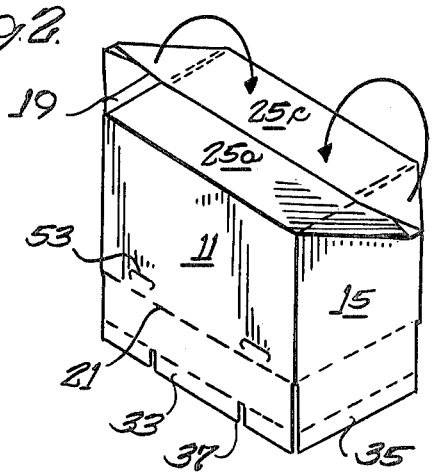
FIG. 2 is a view similar to FIG. 1 showing the bottom closure of the tubular blank partially closed.

In closing the bottom of the container, the flap 25*a* is first folded to a generally horizontal orientation causing the flaps 25*b* and 25*d* to fold outwardly, as shown in FIG. 2, and the flap 25*c* is then folded downward over the flap 25*a*—the dimensioning being such that there is a slight overlapping between the flaps 25*a* and 25*c*. Next, the flaps 25*b* and 25*d* which are now generally triangular are folded inward to complete the bottom closure, and the particular disposition of the score lines effects an overcenter locking action, which is described in the just aforementioned patent. Accordingly, the empty container can now be turned over, from its inverted position in which the bottom closure is preferably set up, to the normal position depicted in FIG. 3 without fear of the closure opening.

A pair of major top flaps 27*a* and *b* are hinged to the side walls 11 and 13 along the upper score line 21, which flaps extend for the full length of the side walls, and a pair of minor top flaps 29*a* and 29*b* are hingedly attached to the upper edges of the end walls 15 and 17, which flaps also extend for the full length of the end walls. For manufacturing economy, the height or depth of the flaps 27 and 29 is preferably equal and the flaps are defined by slots in alignment with four vertical score lines which extend from the free edge to the horizontal score line 21. In addition, each of the flaps 27 and 29 includes an additional score line 31 which is parallel to the score line 21, and the score lines 31 form subflaps 33 and 35 near the free edge of each of the top flaps. In addition, the major flaps 27*a* and 27*b* include a pair of short slots 37 which extend from the free edge to the score line 31 and shorten the operative length of the subflaps 33 for a purpose explained hereinafter.

Figure 3:
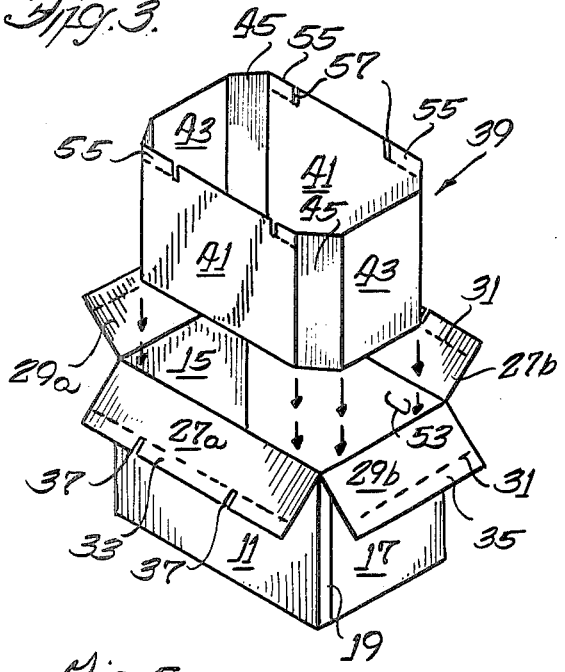
FIG. 3 is an exploded perspective view of a partially set up container formed from the blank shown in FIGS. 1 and 2, with its bottom closure completed with an inner liner being inserted downward into the open upper end.
Figure 4:
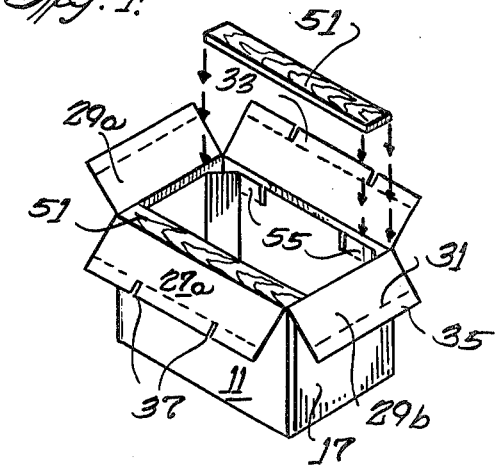
FIG. 4 is a view similar to FIG. 3 showing the inner liner and one rigid longitudinal support in place and with a second support being moved into position.

An octagonal cross section liner 39, which is formed from a corrugated fiberboard blank in which the flutes run vertically, is disposed as a generally friction fit within the interior of the container, as shown in FIG. 3. The liner 39 includes a pair of facing major panels 41 and a pair of opposite minor panels 43, all of which are defined by vertical score lines. Relatively narrow transitional panels 45 are disposed between each pair of adjacent panels 41 and 43. The main major panels 41, in the installed position, lie in a face-to-face abutting relationship with the side walls 11 and 13, whereas the minor panels 43 lie in face-to-face contact with the interior surface of the end walls 15 and 17. The narrow transitional panels 45 span the four corners (see FIG. 4), and the upper edges thereof provide lines of support for locating a rigid longitudinally extending member 51, preferably a wood slat. Accordingly, the height of the liner 39 is proportioned so that its upper edge is spaced a predetermined distance below the upper horizontal score line 21 along which the top flaps are hinged and thus provides clearance to accommodate the wood slats 51 just below the undersurface of the major top flaps 27*a* and 27*b*.

Die-cut in each of the side walls 11 and 13 are a pair of partial openings 53 formed by arcuate or C-shaped cuts or slits. Thus, in the tubular blank, the opening 53 remains closed by its integral plug or flap of the side wall material which is hinged to the remainder of the side wall along an upper horizontal line. The opening 53 is positioned so that this upper hinge line is spaced the aforementioned predetermined distance below the upper horizontal score line 2. Each pair of openings are horizontally spaced apart a distance equal to the standard spacing between the tines of a forklift truck, and the openings 53 are sized to accommodate passage therethrough of the forklift truck tines. In addition, the openings 53 are preferably spaced equidistant from the lateral edges of the side walls 11 and 13.

The upper edges of the major panels 41 of the liner 39 are provided with pairs of tabs 55 which are formed by short slots 57 extending downward from the upper edge, which tabs are hinged to the remainder of the panel along the horizontal score lines 59. The tabs 55 are located and proportioned to lie directly inside the flaps in the container side walls which fill the openings 53.

Figure 5:
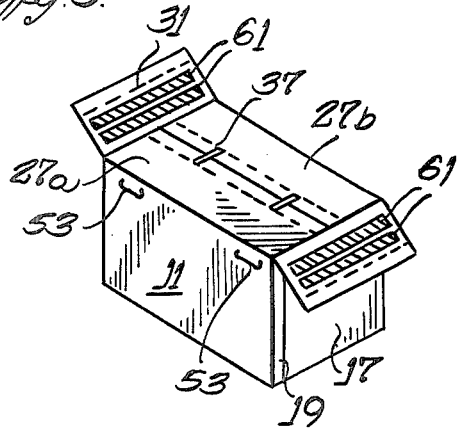
FIG. 5 is a view similar to FIG. 4 showing the container with the major top flaps closed and with a glue pattern applied to the minor flaps.
Figure 6:
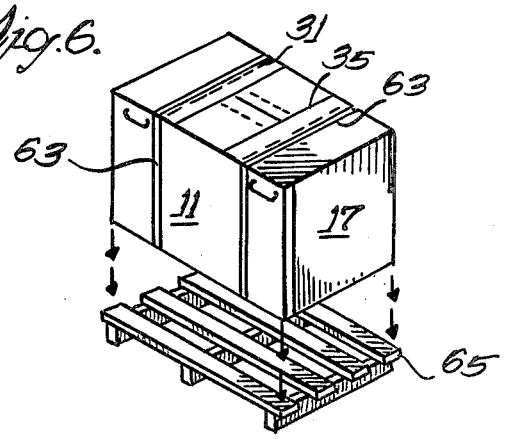
FIG. 6 shows the still empty container of FIG. 5 having a pair of bands encircling the region of the minor flaps as it is being set upon a pallet.

After both of the wooden slats 51 have been installed, the major top flaps 27*a* and 27*b* are folded inward into position over the slats, and a glue pattern 61 is applied to the portions of the minor flaps 29*a* and 29*b* lying between the score lines 31 and 21, as depicted in FIG. 5, or to the equivalent locations on the upper surface of the infolded major flaps 27*a* and 27*b*. The minor flaps 29 are then folded down atop the major flaps and a pair of encircling bands 63 are applied to the container (see FIG. 6) which bands may be made of nylon, steel or some other suitable, high tensile-strength material. The bands 63 are positioned so that they lie between the score lines 31 and 21 and do not interfere with the subflaps 35 of the minor flaps. The bands 63 also lie interior of the inner lateral edges of the partial openings 53.

The closed but still empty container is then mated with a pallet 65 when it is ready to be filled. It may be temporarily adhered to the pallet using a pressure-sensitive adhesive or the like, or it may be simply set atop the pallet 65, relying upon the considerable friction between the pallet and the filled bulk container to prevent inadvertent separation. If felt necessary to guard against rough handling and/or shipping, the filled container may be attached to the pallet by additional strapping, shrink wrap or the like, which would be removed prior to unloading the container.

Figure 7:
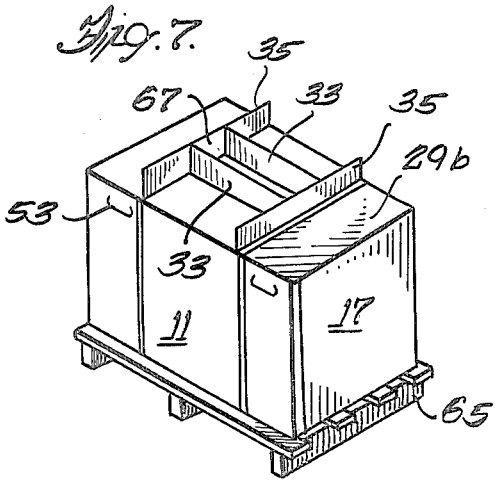
FIG. 7 shows the container of FIG. 6 with its top closure formed into a central inlet through which the container is filled with flowable bulk material.

The container-pallet combination is then located below a filling station, and the subflaps 35 of the minor top flaps 29*a* and *b* are folded upward along the score lines 31. Then the portions of the subflaps 33 of the major flaps 27*a* and *b* lying between the slots 37 are then likewise folded upward to create a central inlet 67 into the interior of the container, as depicted in FIG. 7. The length of the subflaps 33 is determined by the placement of the slots 37 and is proportioned such that their lateral edges will frictionally engage the subflaps 35 which, due to the inherent resiliency of corrugated fiberboard, will be biased to the closed position. The short slots 37 are aligned with the score lines 31 in the end flaps 29 when the upper closure is completed. Thus, once all four subflaps 33,35 have been upfolded, the central inlet 67 will remain in the open position until further manipulated.

Figure 8:
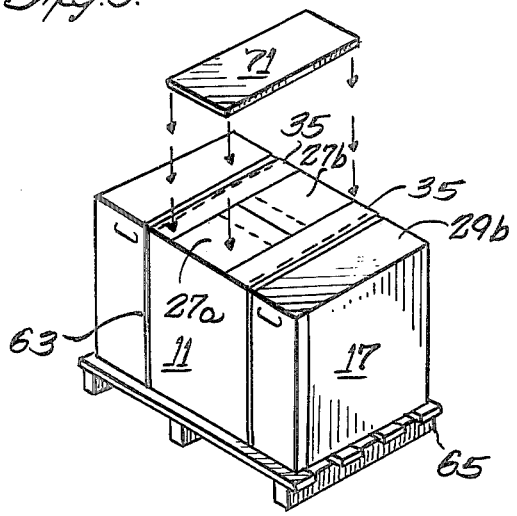
FIG. 8 shows the filled container of FIG. 7 with the top closure in closed position and with a pad being applied to the region of the inlet.
Figure 9:
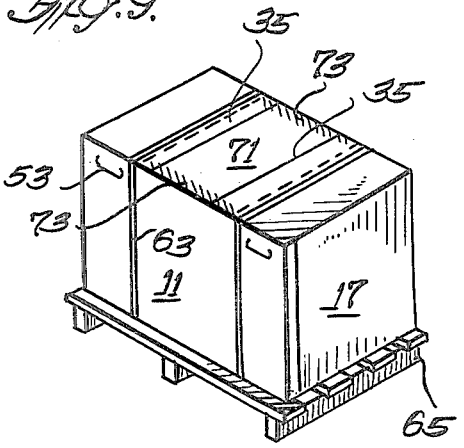
FIG. 9 shows the container of FIG. 8 with the pad and the top closure secured in closed condition.

A filling spout, either positioned directly above the central inlet or lowered into position to about the level of the inlet, is used to fill the bulk container with the desired load of granular flowable material. When filling is completed, the subflaps 33 are closed, and the subflaps 35 are folded back into the flattened condition shown in FIG. 8. To secure the top closure against inadvertent opening which could result in contamination or escape of the contents and to rigidify the top closure, a top pad 71, in the form of a sheet of corrugated board or the like, is placed atop the center portion of the major flaps 27*a* and 27*b*, as depicted in FIG. 8.

The top pad 71 is appropriately secured in position to complete the closure, for example by gluing with hot melt adhesive, by stitching or preferably by the application of rows of staples 73. The presence of the rigid wooden slats 51 in the regions along the lateral edge of the container permits an extremely secure arrangement to be created by stapling downward into the wood itself. Preferably, the rows of staples 73 not only extend along the opposite edges of the pad 71, but they also extend through the subflaps 35. The illustrated arrangement securely unites the rigid wood slats 51 to the bulk container along the longitudinal upper edges and secures the overlapping major and minor top flaps to the slats which contributes to the squareness and integrity of the overall package.

Figure 10:
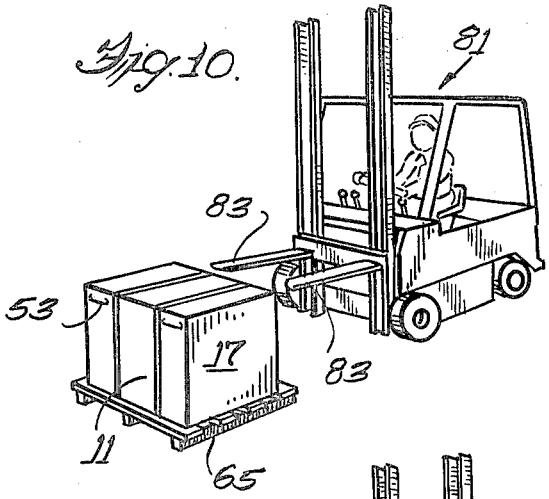
FIG. 10 shows the bulk container of FIG. 9 at its destination as a forklift truck prepares to move it to an unloading location.

The palletized bulk container is then transported, as by truck or railroad, to its intended destination where it may be stored in a warehouse section until the contents are to be used. To remove the container from warehouse storage and utilize its contents, a lift truck driver aligns his forklift 81 with the palletized bulk container, as depicted in FIG. 10, so the ends of the forklift tines 83 line up with the integral flaps which close the openings 53 in the bulk container side wall.

The operator then drives the forklift forward so that the tines 83 of the fork penetrate directly through the bulk container, entering through the two openings 53 on one side wall and protruding outward through the pair of openings 53 on the opposite sidewall. Accordingly, the flaps in the sidewall 13 which otherwise fill the openings 53 are forced inward and pivot upward, being squeezed between the upper surface of the tines 83 and the undersurface of the wooden slats 51, while the adjacent tabs 55 in the liner 39 are bent inward and downward. After traversing the interior of the upper region of the bulk container, the ends of the tines 83 force the tabs 55 on the opposite panel 41 of the liner outward and downward through the openings 53 in the side wall 11, thus squeezing the tabs between the undersurface of the tines and the lower straight-edge portion of the openings 53. The integral flap portions that fill the openings 53 of the sidewall 11 are accordingly bent upward, and depicted in FIG. 11.

Figure 11:
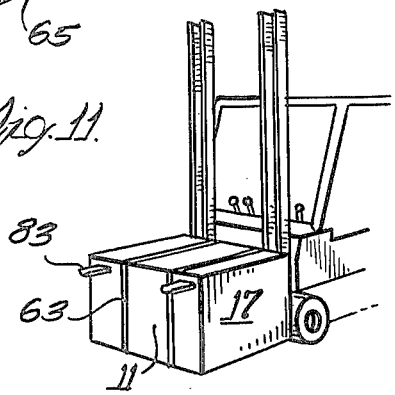
FIG. 11 shows the container of FIG. 10 being moved by the forklift truck to the unloading location.

The operator will then raise the fork to clear the pallet 65, as depicted in FIG. 11, and drive the forklift truck 81 to a location where the bulk container is positioned directly over a receptacle 85 in the floor (FIG. 12), a low conveyor along the floor, or a bin or hopper at a location below the level or the forklift truck, into which the contents of the bulk container are to be unloaded. The rigid, longitudinally extending wooden slats 51 serve to spread the weight of the bulk container fairly uniformly along both longitudinal edges of the upper region of the bulk container and allow the container (which typically may have a weight of about 1000–3000 lbs.) to be transported without the use of the underlying pallet, which will now have been separated from the bulk container. Of course, the container can be transported on the pallet to a location near the dumping area if desired, and any additional straps or wrapping uniting it to the pallet are removed to permit separation of the container from the pallet.

Figure 12:
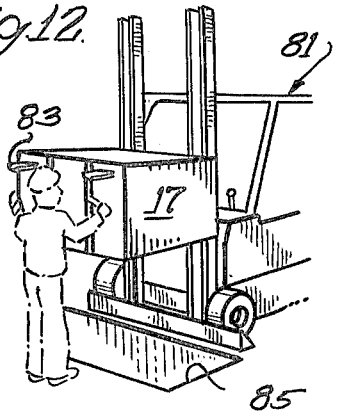
FIG. 12 shows the container of FIG. 11 in position above a receptacle into which its contents are to be unloaded.
Figure 13:
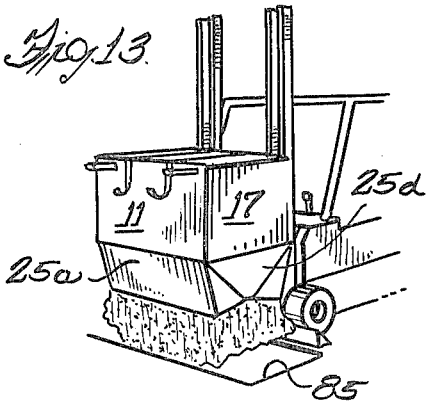
FIG. 13 shows the container of FIG. 12 with its contents being dumped through the bottom closure.

With the bulk container poised on the forklift truck directly above the receptacle 85 or other receiving location, as depicted in FIG. 12, a worker simply severs the two encircling bands 63, with snips or the like, and the entire contents of the bulk container automatically and completely dumps through the bottom of the box because the bottom closure is preferably only folded together. Moreover, the illustrated preferred bellows-bottom closure forms a natural load-directing chute which helps to guide the falling granular contents into the receptacle 85, as depicted in FIG. 13.

The invention provides a novel bulk container which can be used to effect palletized shipment of large quantities of flowable material to a desired destination employing relatively inexpensive corrugated fiberboard material. Once at the destination and the contents are desired for use, the bulk container can be separated from its underlying pallet, transported mechanically from warehouse storage and effectively, quickly and completely unloaded through its bottom.

Although the invention has been described with regard to a presently preferred embodiment, it should be understood that changes and modifications as would be obvious to one having the ordinary skill in this art are intended to be within the scope of the invention which is defined solely by the claims appended hereto. Specific features of the invention are emphasized in the claims which follow.

What is claimed is:

1. A bottom-unloading bulk container which comprises a body having a pair of vertical sidewalls and a pair of vertical end walls, bottom closure means closing the opening at the bottom of said body, top closure means covering the opening at the upper end of said body which includes a pair of top flaps hinged to the top edges of said sidewalls, openings means in said side walls spaced apart from each other and proportioned to receive the protruding tines of a forklift truck, rigid support means extending generally longitudinally of said body transverse to said end walls, said opening means being located a predetermined distance below the top edge of said sidewalls, which distance is about equal to the vertical dimension of said rigid support means, means for locating said rigid support means just above said sidewall opening means, and banding means encircling said body and said top and bottom closure means to secure said bulk container during shipment whereby said container can be lifted and transported to an unloading location by a forklift truck whose tines extend through said opening means in said sidewalls and its contents dumped through the bottom opening upon release of said encircling banding means.

2. A container in accordance with claim 1 wherein said bottom closure means is hinged to the bottom edges of said body walls.

3. A container in accordance with claim 2 wherein said bottom closure is a bellows-folded sleeve.

4. A container in accordance with claim 1 wherein said top opening is rectangular and said top closure means includes four flaps respectively hinged to the top edges of said body walls, each of said flaps having score line means parallel to the free edge thereof to form a subflap, said subflaps being foldable upward following installation of said banding means to provide a central inlet through which said container can be filled.

5. A container an accordance with claim 4 wherein said top flaps which are hinged to said side walls extend for substantially the length of said side walls and each contains a pair of cuts extending between its free edge and said subflap-defining score lines, each of said pair of cuts being generally aligned with said subflap-defining score line means in said end wall flaps when said top closure is in closed condition.

6. A container in accordance with claim 4 wherein said locating means includes an inner liner having a height less than the height of said body walls by an amount about equal to said predetermined distance.

7. A container in accordance with claim 6 wherein said liner includes foldable tab means along the upper edge thereof which tab means are aligned with each of said opening means in said side walls.

8. A container in accordance with claim 5 wherein said container is filled with flowable material and has pad means fastened to the upper surface of said side wall top flaps in the region between the free edges of said end wall top flaps.

9. A container in accordance with claim 8 wherein fastening means extends downward through said pad means, said top closure means and into said rigid support means.

10. A bottom-unloading bulk container which comprises a body having a pair of vertical sidewalls and a pair of vertical end walls forming a compartment of rectangular cross section, bottom closure means closing the opening at the bottom of said body, top closure means covering the opening at the upper end of said body which includes a first pair of top flaps hinged to the top edges of said sidewalls and a second pair of top flaps hinged to the top edges of said end walls, each of said flaps having score line means parallel to the free edge thereof to form a subflap, opening means in said sidewalls spaced apart from each other and proportioned to receive the protruding tines of a forklift truck, said opening means being located a predetermined distance below the top edge of said sidewalls, an inner liner disposed within said body and having a height less than the height of said body walls by an amount about equal to said predetermined distance, said liner having a plurality of interconnected vertical panels including four major panels which lie adjacent the interior of said body walls and four minor panels which extend across and are spaced from the vertical edges of said body, rigid support means including a pair of wood slats extending generally longitudinally of said body transverse to said end walls, said wood slats being respectively positioned at a location just above said sidewall opening means atop the upper edges of pairs of said minor panels, and banding means encircling said body and said top and bottom closure means to secure said bulk container during shipment, said subflaps being foldable upward following installation of said banding means to provide a central inlet through which said container can be filled, whereby said container can be lifted and transported to an unloading location by a forklift truck whose tines extend through said opening means in said sidewalls and its contents dumped through the bottom opening upon release of said encircling banding means.

11. A container in accordance with claim 10 wherein said liner includes foldable tab means along the upper edge thereof which tab means are aligned with each of said opening means in said sidewalls.

* * * * *